US006601546B1

(12) United States Patent
Mohr et al.

(10) Patent No.: US 6,601,546 B1
(45) Date of Patent: Aug. 5, 2003

(54) COOLING FAN

(75) Inventors: Thomas Mohr, Buehlertal (DE); Juergen Prestel, Karlsruhe (DE); Jens Ulrich, Baden-Baden (DE); Jochen Goehre, Karlsruhe (DE); Joachim Makowsky, Buehlertal (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/719,651

(22) PCT Filed: Apr. 16, 1999

(86) PCT No.: PCT/DE99/01142

§ 371 (c)(1),
(2), (4) Date: Feb. 12, 2001

(87) PCT Pub. No.: WO00/63561

PCT Pub. Date: Oct. 26, 2000

(51) Int. Cl.[7] ..... F01P 5/02

(52) U.S. Cl. ..... 123/41.49; 417/423.1; 417/423.15

(58) Field of Search ..... 123/41.49, 41.1, 123/41.11, 41.14, 41.44, 41.65; 417/423.1, 423.7, 423.15

(56) References Cited

U.S. PATENT DOCUMENTS 5,660,149 A * 8/1997 Lakerdas et al. ..... 123/41.44

FOREIGN PATENT DOCUMENTS

| | | | |
|---|---|---|---|
| DE | 196 12 679 A | | 10/1997 |
| FR | 2 766 235 A | | 1/1999 |
| FR | 2 766 302 A | | 1/1999 |
| JP | 62-251418 A | * | 11/1987 |

OTHER PUBLICATIONS

Patent Abstracts of Japan vol. 012, No. 126 (M–687), Apr. 19, 1988 & JP 62 251418 A, Nov. 2, 1987.

* cited by examiner

*Primary Examiner*—Henry C. Yuen
*Assistant Examiner*—Hyder Ali
(74) *Attorney, Agent, or Firm*—Michael J. Striker

(57) ABSTRACT

The invention is based on a cooling fan (10) with a frame (12), having a baffle apparatus (14) with an electric motor (16) fastened to it which drives a fan propeller (18).

Figure 1:
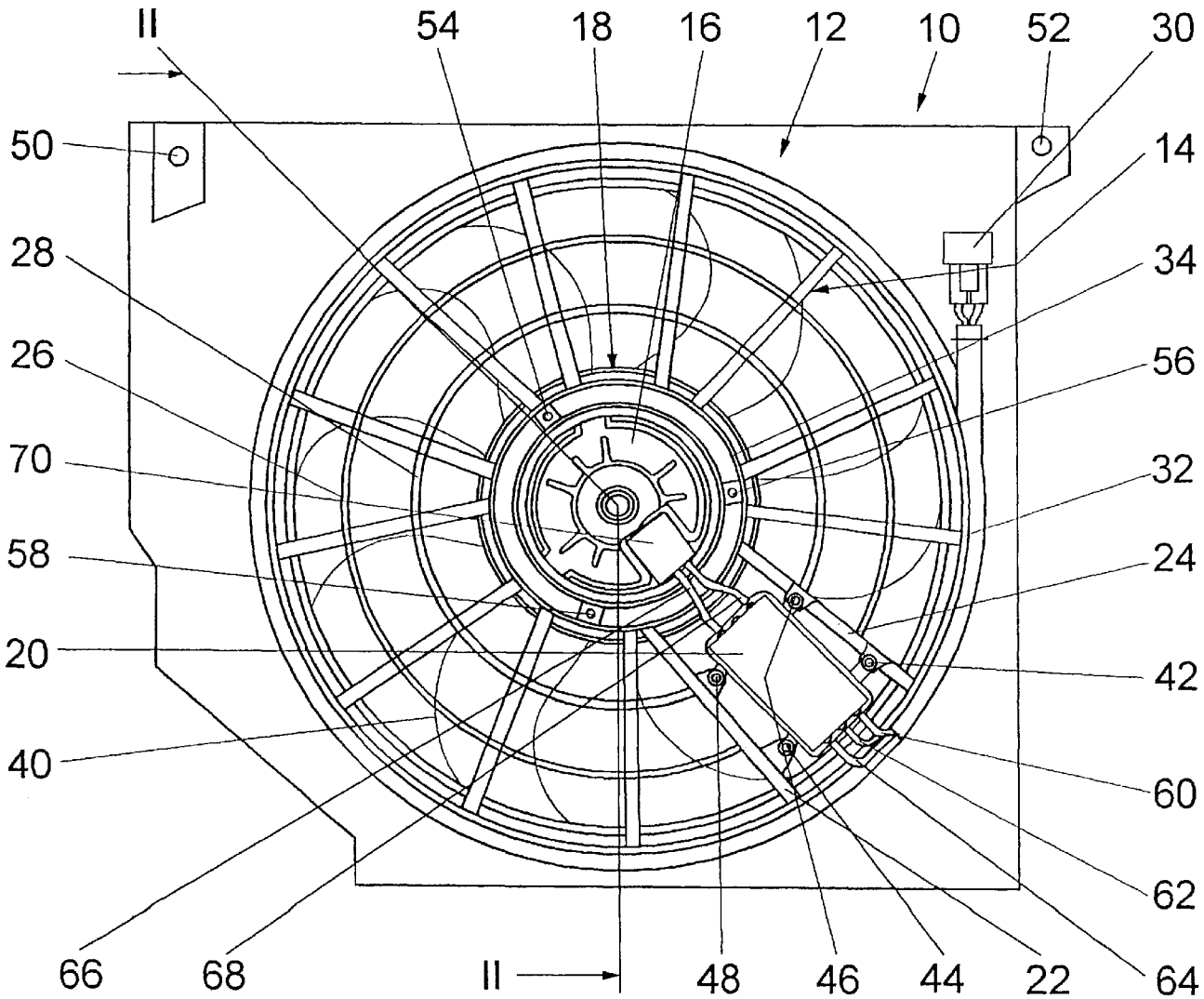

The invention proposes that a control unit (20) for the electric motor (16) be integrated into the frame (12).

2 Claims, 2 Drawing Sheets

COOLING FAN

PRIOR ART

The invention is based on a cooling fan according to the preamble to claim 1.

Internal combustion engines are frequently cooled to a desired operating temperature by electrically driven cooling fans. Known cooling fans having two-speed electric motors or electric motors with series resistors must be frequently switched on and off in order to maintain a precise operating temperature. They are intermittently operated with an unnecessarily high speed and then are switched off again at a particular temperature, as a result of which more energy than necessary is expended for the cooling process and the temperature of the internal combustion engine fluctuates around the optimal temperature, usually slightly above or below it. Both lead to an increased energy demand and therefore to an increased fuel consumption. Furthermore, unnecessarily high fan noise is produced.

In order to prevent this, a cooling fan in modern motor vehicles is regulated by a control unit which smoothly adjusts the speed of a cooling fan to corresponding operating states. The control unit is an additional component which is affixed in the engine compartment separate from the cooling fan, preferably in a cool region, so that the electronics are not damaged or destroyed by high temperatures, for example in the vicinity of a headlight. The mounting location of the control unit can vary and can be different distances from the cooling fan, depending on the layout of the engine compartment in different motor vehicles, construction machines, and other machines driven by internal combustion engines. As the distance increases, so do the materials expenditures for cable and fasteners and the installation expense. Furthermore, longer cable routings lead to electromagnetic interference, for example interference with the internal combustion engine control or interference with a radio.

ADVANTAGES OF THE INVENTION

The cooling fan according to the invention has a support structure, also referred to as a frame or housing, into which a control unit is integrated, i.e. it is fastened onto or into the frame. The cooling fan is a functional component that can be suitably developed as a whole in one place and can be optimized with regard to its function, noise production, and effectiveness. Furthermore, the cooling fan can be suitably preassembled and then its function can be fully tested before installation into a motor vehicle. Possible damage to the control unit in a separate assembly is prevented and additional space in the engine compartment is no longer required.

In all uses of the cooling fan, the control unit is fastened into or onto the frame and is protected against external influences. Because of its spatial connection to the cooling fan, the control unit is easy to find and access when testing the function of the cooling fan in a workshop, regardless of the vehicle type. All of the cables can be advantageously united in the frame to form an interface or plug connector, by means of which the cooling fan can be connected in a particularly simple and rapid fashion. Generally, plug connectors are cost intensive components and are frequently the weak point in the system. Having only one plug connector or one interface reduces the number of weak points and components, and reduces costs.

The distance from the control unit to the electric motor of the cooling fan is particularly short, as a result of which a short reaction time of the cooling fan can be achieved and in a small and limited span, no disturbance variables or only slight disturbance variables such as electromagnetic waves can travel outward from the control unit and/or the electric motor and possibly act externally on the control unit. Due to the small distance, there are savings in cable length and fasteners such as clamps, etc. Fewer components have to be mounted in the final assembly. The assembly as a whole is simplified and the cost is reduced.

In one embodiment of the invention, the proposal is made to affix the control unit to the baffle apparatus in the air flow of a fan propeller and thereby usually also in the relative wind of the motor vehicle. The control unit is directly exposed to the air flow, is cooled particularly well by a high convection, and is thereby protected from overheating even at high temperatures in the engine compartment. It is therefore possible and usually for space reasons also advantageous to fasten the control unit on the side of the baffle apparatus oriented toward the internal combustion engine. Additional cooling devices or insulation devices for the control unit are no longer necessary. Preferably, the control unit replaces and/or supports one or more struts of the frame, as a result of which this frame can be dimensioned as weaker and there can thus be weight and space savings. Moreover, the cooling module to which the regulator is affixed is insulated against oscillation. It is not necessary for there to be a separate decoupling from the vehicle body, e.g. by means of a rubber damper.

Primarily the temperature of the internal combustion engine is used as a regulating variable for the control unit and is usually detected by means of the coolant temperature, wherein additional variables of the operating state, e.g. the motor vehicle being at rest, speed of the engine, etc., can also be used by the control unit in order to react to temperature changes as early as possible. Furthermore, the control unit can be used for the detection of defects such as a defective electric motor, a jammed fan propeller, etc., and also to perform safety functions. According to the invention, the control unit performs the safety function of limiting the output of the electric motor. The cooling fan is thus an intrinsically automatic and safeguarded system, by means of which additional safety devices besides the cooling fan are no longer necessary. The cooling fan absorbs switching peaks which can damage the electric motor, allows the electric motor to accelerate smoothly, and limits the maximal current.

DRAWINGS

Other advantages ensue from the following description of the drawings. The drawings show an exemplary embodiment of the invention. The drawings, the description, and the claims contain numerous features in combination. The specialist will also suitably consider the features. individually and will combine them into additional meaningful combinations.

Figure 2:
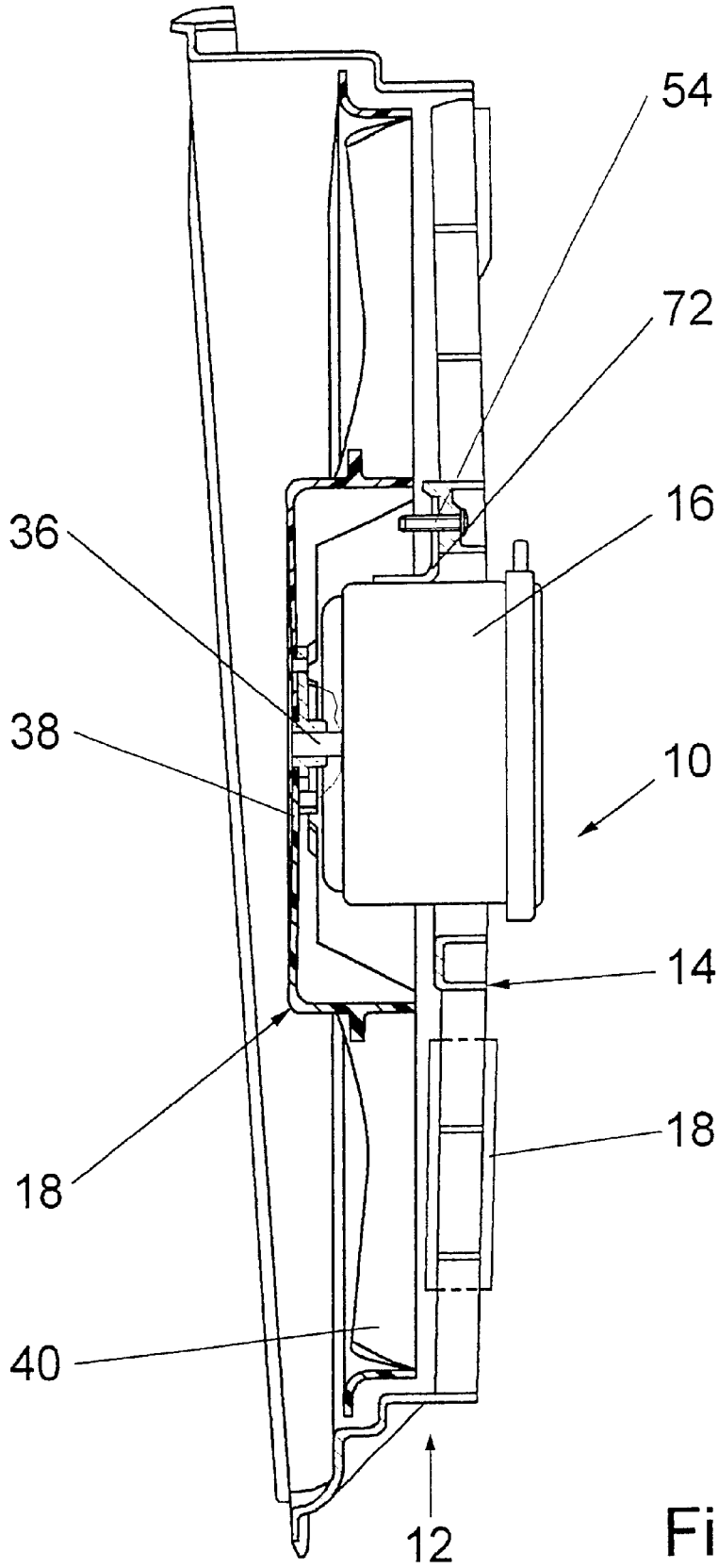

FIG. 1 shows a cooling fan with a control unit, from the side oriented toward the internal combustion engine and FIG. 2 is a section along the line II—II in FIG. 1.

DESCRIPTION OF THE EXEMPLARY EMBODIMENT

FIG. 1 shows a cooling fan 10 that has a frame 12 with which the cooling fan 10 is fastened in the engine compartment by means of two fastening points 50, 52. The frame 12 includes an impeller, or baffle apparatus 14 which has two circumferential struts 26, 28 and a number of radial vanes or struts 22, 24 that extend outward to a circumference 32 and towards the center of the impeller [baffle apparatus] 14 to a securing ring 24. An electric motor 16 is fastened to the securing ring 34 with three screws 54, 56, 58 by means of three angled plates 72 and the electric motor drives a fan propeller 18 by; means of a drive shaft 36. The fan propeller 18 is comprised of a hub 38 and fan blades 40 connected to this hub (FIG. 2). The torque produced by the electric motor 16 and the forces generated by the fan propeller 18 are absorbed by the stationery securing ring 34, the impeller 14, and the frame as a whole, along with its connection to the motor vehicle.

The speed of the electric motor 16 is controlled by a particularly small control unit 20, which is fastened to the baffle apparatus 14 between two struts 22, 24 in the air flow of the fan propeller 18 with four screws 42, 44, 46, 48 and is therefore easy to install and remove. The control unit 20 is enclosed on the outside by a housing which protects the electronics and contact points from environmental influences, for example salt bridge formation, etc. The control unit 20 is disposed in a flat orientation between the struts 22, 24 and therefore replaces the circumference struts 26, 28 between the struts 22, 24, which reduces the weight. The control unit produces an increased rigidity of the baffle apparatus 14 so that this baffle apparatus, at least in the vicinity of the control unit, can be embodied as weaker, which results in further weight savings. Finally, the asymmetrical mass distribution prevents the control unit on the baffle apparatus 14 from being excited to harmonically oscillate.

The control unit 20 protrudes with its height as far as possible between the struts 22, 24, which makes favorable use of the depth and width of the space between the struts 22, 24 and no additional space or only a slight amount of space is required for the control unit 20. Furthermore, the air flow strikes the control unit 20 frontally against a large surface area and therefore cools it particularly well. Fundamentally however, the control unit 20 can also be fastened at any point to the frame 12 or outside of the baffle apparatus 14 and in any orientation, for example edgewise and can be fastened to only one strut, as a result of which the flow cross section of the air is only slightly reduced.

The control unit 20 and the electric motor 16 are externally supplied with electricity only by means of a plug connector 30 which means that the cooling fan 10 can be connected in a particularly simple and rapid manner. Starting from the plug connector 30, the cables 60, 62, 64 are bundled together and routed along the circumference 32 and then extend into the control unit 20, from which two power cables 66, 68 lead into the electric motor 16 and are protected by a cover 70.

Although the cooling fan 10 is particularly used for internal combustion engines, it is also well-suited for cooling other drive units.

What is claimed is:

1. A cooling fan (10), comprising a fan propeller (18) that is driven by an electric motor (16), wherein said electric motor is fixedly connected to a frame (12) by means of connecting elements (14, 22, 24, 34, 72), wherein the frame (12) surrounds fan blades (40) of the fan propeller (18) on an outer periphery, said frame (12) being connected to an electronic control unit (20) for the electric motor (6) by means of one of said connecting elements (22, 24), wherein the connecting elements (14, 22, 24, 34, 72) comprise an impeller (14), said impeller (14) having vanes (22, 24) spaced from one another about a periphery of said impeller (14), wherein said vanes (22, 24) are fixedly connected with the frame (12) on a circumference (21) and with a securing ring (34), said electric motor (16) being attached to said securing ring (34), and wherein the control unit (20) is disposed and removably secured between two neighboring struts (22, 24), wherein the electric motor (16) and the control unit (20) are connected by means of only one interface (30) with a motor vehicle, and wherein lines (60, 62, 64) to a cable (76) clustered along the circumference (32) of the frame (12) are guided from the interface (30) to the control unit (20), wherein said supply lines (66, 68) lead from said control unit (20) to said electric motor (16).

2. A cooling fan (10), comprising a fan propeller (18) that is driven by an electric motor (16), wherein said electric motor is fixedly connected to a frame (12) by means of connecting elements (14, 22, 24, 34, 72), wherein the frame (12) surrounds fan blades (40) of the fan propeller (18) on an outer periphery, said frame (12) being connected to an electronic control unit (20) for the electric motor (6) by means of one of said connecting elements (22, 24), wherein the connecting elements (14, 22, 24, 34, 72) comprise an impeller (14), said impeller (14) having vanes (22, 24) spaced from one another about a periphery of said impeller (14), wherein said vanes (22, 24) are fixedly connected with the frame (12) on a circumference (21) and with a securing ring (34), said electric motor (16) being attached to said securing ring (34), and wherein the control unit (20) is disposed and removably secured between two neighboring struts (22, 24), wherein circumferential struts (26, 28) connect said vanes (22, 24) to one another and reciprocally support said vanes (22, 24), and wherein the control unit (20) assists said circumferential struts (22, 24) in supporting said vanes (22, 24) or replaces said circumferential struts between neighboring vanes (22, 24).

* * * * *